United States Patent [19]

Fisher

[11] 4,056,940

[45] Nov. 8, 1977

[54] TRENCH BOX HEIGHT ADAPTOR

[75] Inventor: Walter A. Fisher, Coldwater, Mich.

[73] Assignee: Griswold Machine & Engineering, Inc., Union City, Mich.

[21] Appl. No.: 735,011

[22] Filed: Oct. 26, 1976

[51] Int. Cl.[2] ..... E21D 5/00; E21D 5/12

[52] U.S. Cl. ..... 61/41 A; 61/105

[58] Field of Search ..... 61/41 A, 41 R, 39.1, 61/63, 84, 105

[56] References Cited

U.S. PATENT DOCUMENTS

| | | | |
|---|---|---|---|
| 2,777,294 | 1/1957 | Rosa et al. | 61/41 A |
| 2,865,178 | 12/1958 | Wicke | 61/41 A |
| 2,956,409 | 10/1960 | Wicke | 61/41 A |
| 3,541,799 | 11/1970 | Jost et al. | 61/41 A |
| 3,782,126 | 1/1974 | Pavese | 61/41 A |
| 3,820,345 | 6/1974 | Brecht | 61/41 A |

*Primary Examiner*—Dennis L. Taylor
*Attorney, Agent, or Firm*—McGlynn and Milton

[57] ABSTRACT

A trench shoring assembly including first and second spaced walls having upper surfaces with third and fourth spaced walls stacked upon the upper surfaces of the first and second walls. A plurality of tubular collars project from the various walls and are aligned vertically at each end thereof. Spreader pipes interconnect these collar projections at one end of the assembly and a spreader assembly interconnects the stacked walls at the other end. More specifically, the spreader assembly includes vertically extending metal beams interconnecting the collars projecting from the walls and tie bars extending between the vertical beams at a position spaced well above the upper surfaces of the lower walls thereby facilitating a pipe having a diameter which is greater than the vertical height of the lowermost walls. In the first embodiment the tie bars are adjustable to vary the spacing between the spaced walls, whereas in the second embodiment they are not adjustable and a plate is secured thereto and depends therefrom and includes an arcuate cutout for surrounding the pipe or conduit.

20 Claims, 4 Drawing Figures

TRENCH BOX HEIGHT ADAPTOR

This invention relates to trench shoring assemblies which are also typically referred to as trench boxes. Trench boxes are used in excavation work when pipe or conduit is being laid in a trench. A trench box typically includes two side walls which are spaced apart a fixed distance from each other by a plurality of spreader devices or assemblies affixed to and perpendicular to each side wall. The trench box is positioned in an excavation hole or trench and pipe is laid within the trench box. After each length of pipe is laid, the trench box is moved along the trench for laying the next length of pipe. Of course, the side walls of the trench box prevent the excavation earth on either side of the excavation from falling or caving into the excavated hole or trench before or as the pipe or conduit is being laid in position.

Trench boxes are normally fabricated in standard heights such as, for example, six, eight and ten foot heights. Frequently the excavated trenches are much deeper than the standard trench box height. In the past it has been customary to accommodate such deep trenches by stacking two trench boxes, one upon the other, with the normal connections extending horizontally between the respective walls thereof and including additional connections between the two trench boxes. It is also frequently necessary to have very high wall trench box systems to accommodate very large diameter conduits such as conduit approximately eight feet in diameter. The laying of such conduit is not facilitated by trench boxes previously known which are of standard sizes and stacked one upon the other because the connections between the side walls of the lower trench box are too low for allowing the conduit to extend therethrough as the trench boxes move along the trench after a section of conduit is disposed between the walls of the trench box assembly. Accordingly, to solve that problem, it has been necessary to fabricate trench boxes with extraordinary high walls. The problem with such extraordinary high walls is that it is very difficult to ship such walls from their point of fabrication to the construction sight because of shipping regulations as, for example, the load width limitation upon highway trucks. In other words, a twelve foot high side wall for a trench box assembly laid flat on its side on the flat bed of a truck would define an extraordinary wide load.

Accordingly, the subject invention solves these problems by providing a trench shoring assembly including stacked trench boxes of ordinary height yet including spreader means interconnecting all of the stacked walls at one end thereof and extending across the space between the spaced walls only above the upper extremities of the lower trench box for providing unobstructive space between the spaced wall means up to and above the upper extremities of the lower trench box for accomodating extra large conduit.

Other advantages of the present invention will be readily appreciated as the same becomes better understood by reference to the following detailed description when considered in connection with the accompanying drawings wherein.

Figure 1:
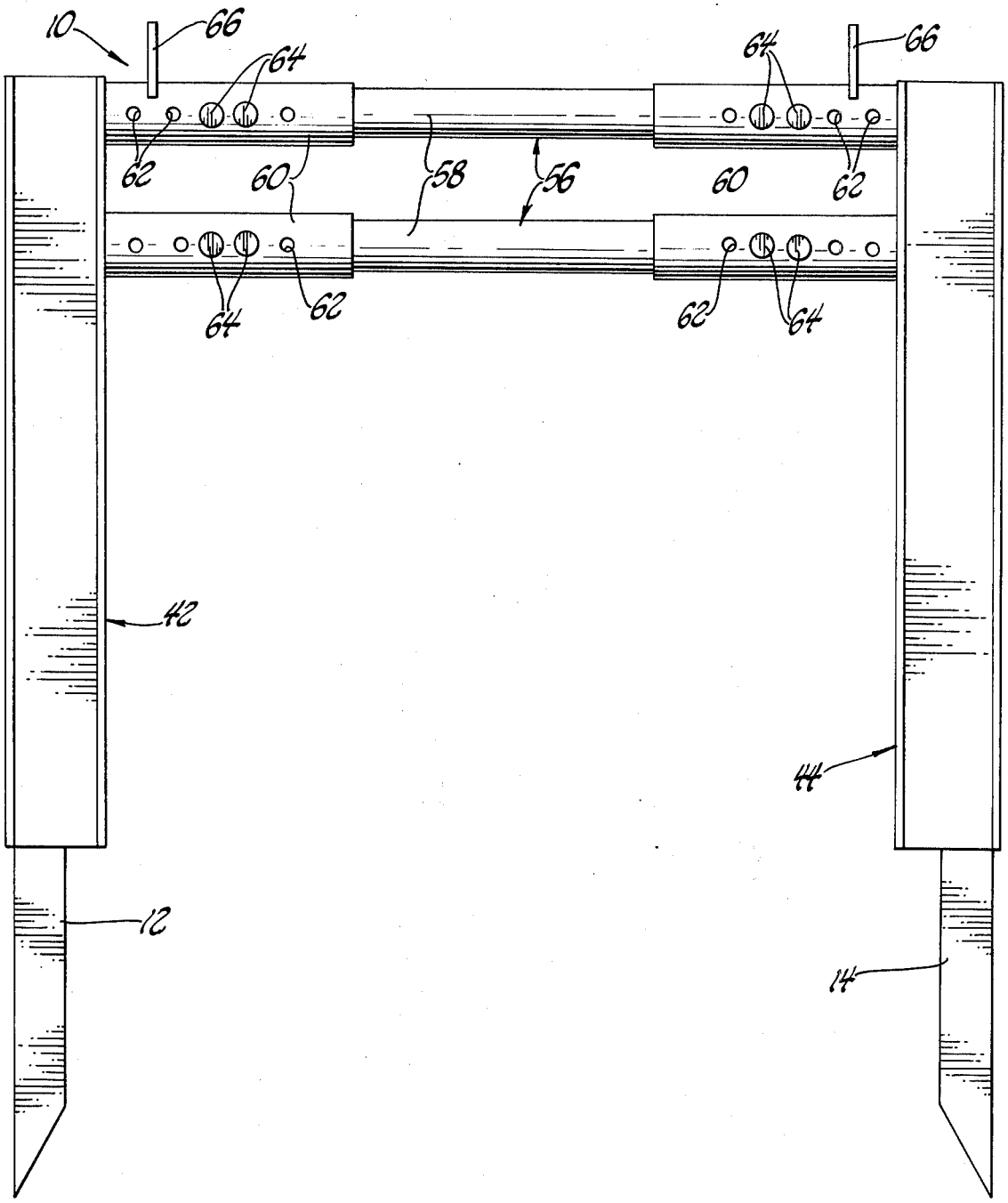
FIG. 1 is an end view of one end of a trench shoring assembly constructed in accordance with the subject invention.
Figure 2:
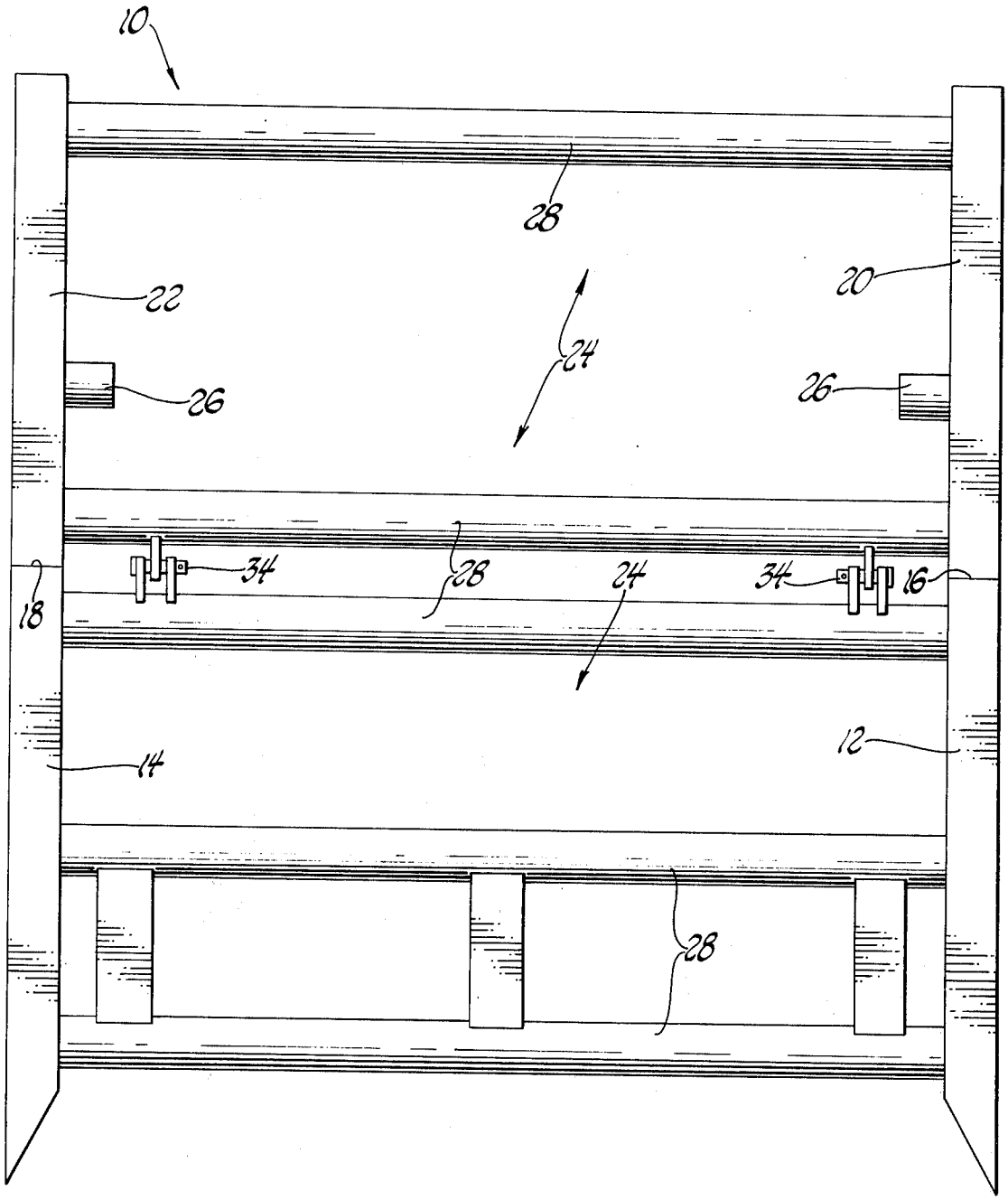
FIG. 2 is an end view from the opposite end of the trench box assembly as shown in FIG. 1.
Figure 3:
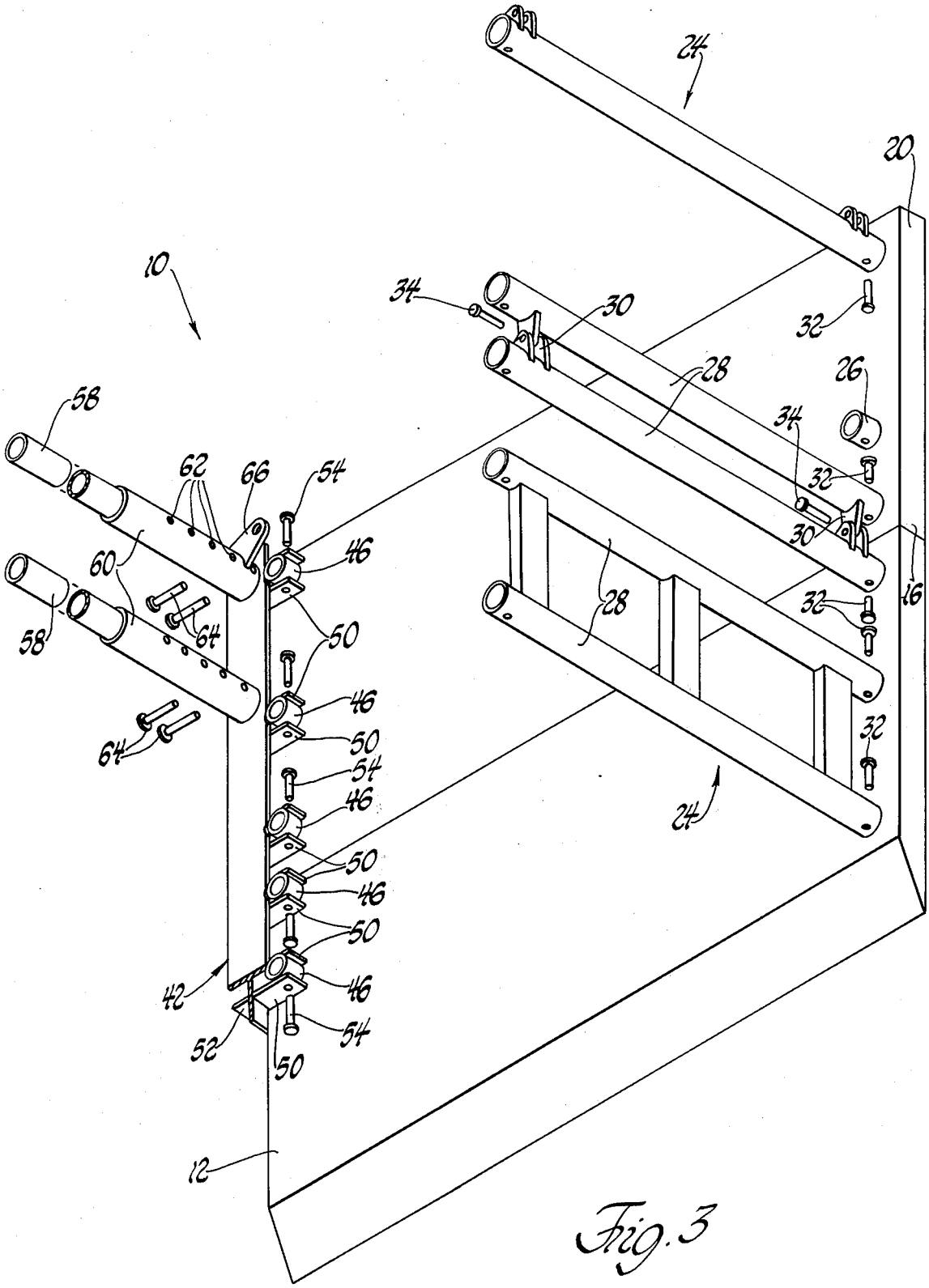
FIG. 3 is an exploded perspective view partially broken away and in cross section showing various components of the trench shoring assembly illustrated in FIGS. 1 and 2.
Figure 4:
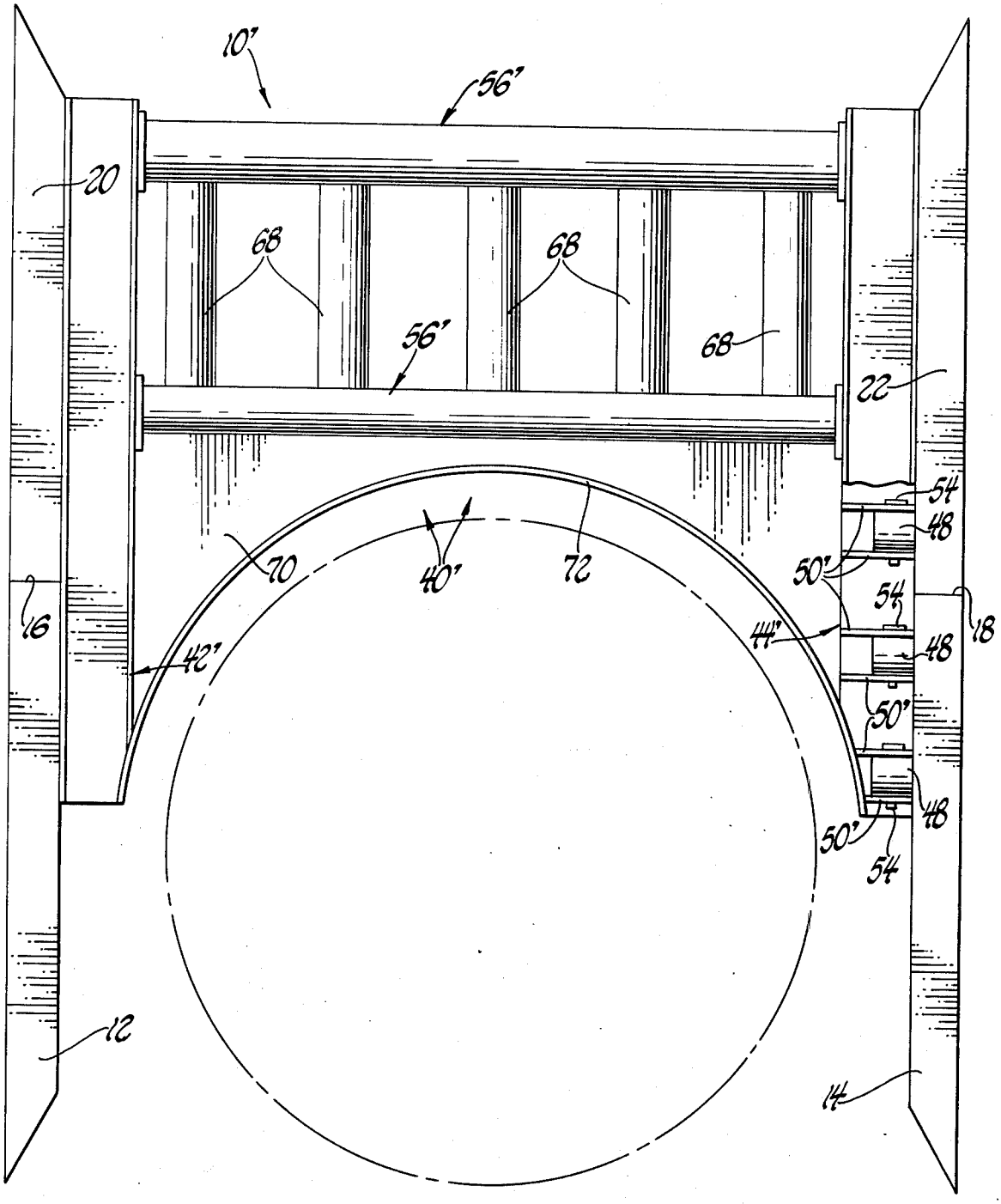
FIG. 4 is an end view partially broken away and in cross section of a second embodiment of a trench shoring assembly constructed in accordance with the subject invention.

Referring to the drawings wherein like numerals indicate like or corresponding parts throughout the several views, a first embodiment of a trench shoring assembly constructed in accordance with the instant invention is generally shown at 10 and a second embodiment is generally shown at 10' in FIG. 4. Each assembly 10 and 10' includes first and second spaced wall means or walls 12 and 14 having the respective upper surfaces or extremities 16 and 18. Also included are third and fourth spaced wall means or walls 20 and 22 respectively stacked upon the upper surfaces 16 and 18 of the first and second walls 12 and 14. The upper surfaces 16 and 18 are horizontal and mate with mating horizontal bottom surfaces on the third and fourth walls 20 and 22. In the embodiment of FIGS. 1 through 3, the third and fourth walls 20 and 22 have horizontal or flat upper surfaces whereas the third and fourth walls 20 and 22 of the embodiment of FIG. 4 are pointed as are the bottoms of all of the first and second walls 12 and 14. The bottoms of the walls are pointed for driving the bottoms into the soil of the excavation. The tops of the walls 20 and 22 of the embodiment of FIG. 4 are pointed, as these two walls may be utilized together, separately and independently of any other walls for defining a trench box by employing normal means for interconnecting the two walls. It will be understood, of course, that the first and second walls 12 and 14 may also be utilized alone without any third and fourth walls 20 and 22 for defining a trench box assembly.

As illustrated in FIGS. 2 and 3, there is included the previously known and utilized first spreader means, generally shown at 24, interconnecting the first ends of the various wall means 12, 14, 20 and 22. Each of the walls includes a plurality of projecting circular collars which are disposed within the ends of variously connected spreader pipe 28. Two of the spreader pipe 28 include the lugs generally indicated at 30 for interconnecting the spreader pipe of the two trench boxes as defined by the walls 12 and 14 for one trench box and the walls 20 and 22 for the second trench box. The ends of the spreader pipe 28 are connected to the circular collars 26 by pins 32 and the lugs 30 are interconnected by the pins 34.

Although not illustrated, the opposite end of the assembly shown in FIG. 4 may be interconnected by a similar spreader system as is shown at 24 in FIGS. 2 and 3.

Each assembly 10 and 10' includes second spreader means, generally shown at 40 and 40' respectively, interconnecting all of the stacked walls 12, 14, 20 and 22 at the second ends of such walls and extending across the space between the walls only above the upper surfaces 16 and 18 of the lower walls 12 and 14 for providing an unobstructed space between the spaced walls of the assembly therebelow.

As is apparent, the third wall 20 is stacked upon the first wall 12 so as to define a substantially continuously upwardly extending vertical wall and, in a similar fashion, the fourth wall 22 is stacked upon the second wall 14 to define another substantially continuously upwardly extending vertical wall.

The second spreader means 40 includes a first connector means generally indicated at 42 interconnecting the first and third walls 12 and 20. The spreader means 40 also includes a second connector means generally indicated at 44 interconnecting the second and fourth walls 14 and 22.

In a similar fashion the embodiment of FIG. 4 includes a first connector means 42′ interconnecting the first and third walls 12 and 20 and a second connector means 44′ interconnecting the second and fourth walls 14 and 22.

The first and third walls 12 and 20 include a first plurality of circular or tubular support projections 46 extending outwardly from and being vertically aligned adjacent the second ends of the walls 12 and 20. In a similar fashion, the second and fourth walls 14 and 22 include a second plurality of like support projections extending outwardly therefrom and being vertically aligned at the second ends thereof. The first connector means 42 and 42′ interconnect the first plurality of support projections 46 and the second connector means 44 and 44′ interconnect the second plurality of support projections 48. Each connector means comprises a metal beam member. Each of the connector means 42, 42′, 44 and 44′ include a plurality of pockets with each pocket engaging opposite horizontal sides of one of the support projections 46 or 48. Each of the pockets includes a pair of parallel horizontal and spaced metal plates 50, in the case of the first embodiment, and 50′, in the case of the second embodiment, which are secured by welding to the metal beam members making up the first and second connector means. The metal beam members 42 and 44 are "I" beams, as viewed in cross section, as best illustrated in FIG. 3, and the plates 50 are secured in the area between the flanges of the beam on one side of the base thereof whereas additional plates 52 are disposed on the opposite side of the base for reinforcing the beams 42 and 44. Each of the beams 42′ and 44′ are defined by a pair of oppositely disposed and spaced channels which are U-shaped in cross section with the plates 50′ being disposed between the two U-shaped channels. The bases of the U-shaped channels are disposed back to back and the legs of each of the U-shaped beams extend away from the legs of the other beam.

Pins 54 extend through each support collar or projection 46 and 48 and through the adjacent pair of metal plates 50 and 50′ defining the pocket in which each support projection 46 or 48 is disposed.

The second spreader means 40 includes the tie bar means including the tie bars generally inducated at 56 extending horizontally above the upper surfaces 16 and 18 and interconnecting the first and second connector means 42 and 44. In a similar fashion, the spreader means 40′includes the tie bar means including the tie bars generally indicated at 56′ extending horizontally above the upper extremities 16 and 18 and interconnecting the first and second connector means 42′ and 44′.

The tie bars 56 include adjustment means for adjusting the length thereof for spacing the walls different distances apart. The adjustment means includes the telescoping members defined by the tubular pipe members 58 which have their ends telescopically received within the larger diameter tubular pipe members 60. Each of the tubular members 58 and 60 include a plurality of holes 62 extending completely through the telescoping members 58 and 60 such that various of the holes may be aligned and the pins 64 disposed through various combinations of the hole 62 for determining the spacing of the walls. In other words, the tubular members 58 have spaced holes therein which may be aligned with various of the holes 62 in the tubular members 60 with the pins inserted therethrough so that the walls may be spaced apart various different distances.

The tubular members 60 include the lugs 66 for further stacking.

The tie bars 56′ illustrated in the embodiment of FIG. 4 include two bars or tubular pipe connected at the respective ends as by welding to the respective beam members 42′ and 44′. There are also included vertical brace members 68 welded to and interconnecting the tubular tie bars 56′. Also included is a plate 70 which is welded to and depends from the lowest of the tie bars 56′ and extends between the beam members 42′ and 44′. The plate 70 includes a circular cutout for accommodating a circular pipe, such as that shown in phantom, and a metal plate 72 is welded in position to define a portion of a cylinder extending about the circular cutout in the plate 70. The purpose of the plate 70 and the plate-like member 72 is to add strength to the assembly.

Various specifics of the structure of the various walls as well as the support collars and the spreader means as illustrated in FIG. 2 are more specifically illustrated and described in applicant's co-pending application Ser. No. 656,146 filed Feb. 9, 1976, now U.S. Patent.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiment of the invention in which an exclusive property or privilege is claimed are defined as follows:

1. A trench shoring assembly comprising; first and second spaced wall means having upper surfaces, third and fourth spaced wall means stacked vertically upon said upper surfaces of said first and second wall means, said third wall means being stacked upon said first wall means to define a first substantially continuously extending vertical wall and said fourth wall means being stacked upon said second wall means to define a second substantially continuously extending vertical wall, first spreader means interconnecting first ends of said wall means, and second spreader means interconnecting all of said stacked wall means at the second ends thereof and extending across the space therebetween only above said upper surfaces for providing unobstructed space between said spaced wall means therebelow, said second spreader means including first connector means extending vertically for interconnecting said first and third wall means and second connector means extending vertically for interconnecting said second and fourth wall means, a first plurality of vertically aligned support means interconnecting said first wall means and said first connector means, a second plurality of vertically aligned support means interconnecting said third walls means and said first connector means, a third plurality of vertically aligned support means interconnecting said second wall means and said second connector means, a fourth plurality of vertically aligned support means interconnecting said fourth wall means and said second connector means, said second spreader means including tie bar means extending horizontally above said upper surfaces and interconnecting said first and second connector means.

2. An assembly as set forth in claim 1 wherein said tie bar means includes adjustment means for adjusting the length thereof for spacing said wall means different distances apart.

3. An assembly as set forth in claim 1 wherein said first and second support means include a first plurality of support projections extending from said first and third wall means and being vertically aligned at said second ends thereof; said third and fourth support means include a second plurality of support projections extending from said second and fourth wall means and being vertically aligned at said second ends thereof, said first connector means interconnecting said first plurality of support projections and said second connector means interconnecting said second plurality of support projections.

4. An assembly as set forth in claim 3 wherein said first and second connector means includes a plurality of pockets with each pocket engaging opposite sides of one of said support projections.

5. An assembly as set forth in claim 4 wherein each of said connector means comprises a metal beam member.

6. An assembly as set forth in claim 5 wherein each of said pockets includes a pair of parallel and spaced metal plates secured to one of said beam members.

7. An assembly as set forth in claim 6 wherein said second spreader means includes a pin extending through each support projection and the adjacent pair of metal plates defining the pocket in which the support projection is disposed.

8. An assembly as set forth in claim 5 wherein said tie bar means includes adjustment means for adjusting the length thereof for spacing said wall means different distances apart.

9. An assembly as set forth in claim 8 wherein said adjustment means includes telescoping members.

10. An assembly as set forth in claim 9 wherein said adjustment means further includes a plurality of holes extending through said telescoping members and pins for extending through various of said holes for determining the spacing of said wall means.

11. An assembly as set forth in claim 5 wherein said tie bar means includes at least two bars connected at their ends to said respective beam members.

12. An assembly as set forth in claim 11 including a plate depending from the lowest of said bars and extending between said beam members.

13. An assembly as set forth in claim 12 wherein said plate includes a circular cutout for accommodating a circular pipe.

14. An assembly as set forth in claim 13 wherein said tie bar means includes vertical brace members interconnecting said bars.

15. A spreader assembly for interconnecting first and second spaced wall means and third and fourth wall means stacked thereon and comprising; first connector means for interconnecting the first and third stacked wall means, second connector means for interconnecting the second and fourth stacked wall means, and tie bar means interconnecting said first and second connector means above the connection of said connector means to the first and second wall means, a first plurality of support means for interconnecting said first wall means and said first connector means, a second plurality of support means for interconnecting said third wall means and said first connector means, a third plurality of support means for interconnecting said second wall means and said second connector means, a fourth plurality of support means for interconnecting said fourth wall means and said second connector means.

16. An assembly as set forth in claim 15 wherein said support means include a plurality of pockets for engaging opposite sides of one of a plurality of support projections extending from the wall means.

17. An assembly as set forth in claim 16 wherein each of said connector means comprises a metal beam member.

18. An assembly as set forth in claim 17 wherein each of said pockets includes a pair of parallel and spaced metal plates secured to one of said beam members.

19. An assembly as set forth in claim 17 wherein said tie bar means includes at least two bars connected at their ends to said respective beam members.

20. An assembly as set forth in claim 19 including a plate depending from the lowest of said bars and extending between said beam members.

* * * * *